US010737816B2

(12) United States Patent
Duchstein et al.

(10) Patent No.: US 10,737,816 B2
(45) Date of Patent: Aug. 11, 2020

(54) DEVICE AND METHOD FOR FILLING A TRANSPORT CONTAINER WITH NOTES OF PECUNIARY VALUE

(71) Applicant: WINCOR NIXDORF INTERNATIONAL GMBH, Paderborn (DE)

(72) Inventors: Mirko Duchstein, Berlin (DE); Gerhard Hupe, Salzkotten (DE); Marek Rybaczyk, Berlin (DE)

(73) Assignee: Wincor Nixdorf International GmbH, Paderborn (DE)

( * ) Notice: Subject to any disclaimer, the term of this patent is extended or adjusted under 35 U.S.C. 154(b) by 291 days.

(21) Appl. No.: 15/688,914

(22) Filed: Aug. 29, 2017

(65) Prior Publication Data

US 2018/0037349 A1 Feb. 8, 2018

Related U.S. Application Data

(63) Continuation of application No. 14/204,575, filed on Mar. 11, 2014, now Pat. No. 9,745,093.

(30) Foreign Application Priority Data

Mar. 11, 2013 (EP) ..... 13158555

(51) Int. Cl.

| | |
|---|---|
| ***B65B 25/14*** | (2006.01) |
| ***B65B 5/06*** | (2006.01) |
| ***B65H 29/46*** | (2006.01) |
| ***B65H 31/22*** | (2006.01) |
| ***B65H 29/40*** | (2006.01) |

(52) U.S. Cl.

CPC ..... *B65B 25/14* (2013.01); *B65B 5/06* (2013.01); *B65H 29/40* (2013.01); *B65H 29/46* (2013.01); *B65H 31/22* (2013.01); *B65H 2404/64* (2013.01); *B65H 2405/311* (2013.01); *B65H 2407/33* (2013.01); *B65H 2701/1912* (2013.01)

(58) Field of Classification Search

CPC ..... B65B 25/14; B65B 35/50; B65H 29/40; B65H 31/06; B65H 31/20; B65H 2701/1912; B65H 5/36; G07D 11/0006; G07D 11/0009; G07D 11/0012; G07D 11/0015; G07D 11/0018

USPC ..... 53/540, 542, 567, 570, 284.7; 271/178, 271/315, 144, 171, 223, 264; 232/43.3, 232/43.2, 1 D, 15, 16

See application file for complete search history.

(56) References Cited

U.S. PATENT DOCUMENTS

| | | | | |
|---|---|---|---|---|
| 5,641,157 A * | 6/1997 | Mays | G07F 7/04 | 271/181 |
| 5,911,416 A * | 6/1999 | Klopfenstein | B65H 39/02 | 270/58.06 |
| 8,353,509 B2 * | 1/2013 | Oota | B65H 31/06 | 271/180 |

(Continued)

*Primary Examiner* — Dariush Seif

(74) *Attorney, Agent, or Firm* — Black, McCuskey, Souers & Arbaugh LPA

(57) ABSTRACT

A device (10) for filling a transport container (12) with notes of pecuniary value, has a displacement unit (700) that conveys the notes of pecuniary value into the transport container (12) through a movable frame (16). When the transport container (12) is closed, the displacement unit (700) is in a second operating state in which its cross sectional area is reduced so far that it passes through the partially closed frame (16).

7 Claims, 5 Drawing Sheets

(56) References Cited

U.S. PATENT DOCUMENTS 9,096,404 B2 * 8/2015 Duchstein ..... B65B 5/106
9,388,624 B2 * 7/2016 Geesmeier ..... G07D 11/13
2002/0096821 A1 * 7/2002 Sato ..... B65H 29/40 271/177
2003/0180131 A1 * 9/2003 Lewis ..... G07D 11/0093 414/411
2005/0121502 A1 * 6/2005 Roberts ..... G07D 11/12 232/15
2009/0066004 A1 * 3/2009 Blaser ..... B65H 29/22 271/3.02
2009/0212486 A1 * 8/2009 Kramer ..... B65H 31/10 271/217
2010/0050572 A1 * 3/2010 Roth ..... B65B 27/08 53/436
2011/0007358 A1 * 1/2011 Beddoe ..... B65H 29/46 358/1.15
2011/0031308 A1 * 2/2011 Holland-Letz ..... B65H 1/025 235/379
2011/0042889 A1 * 2/2011 Holland-Letz ..... B65H 29/40 271/264
2011/0052363 A1 * 3/2011 Brexel ..... B65B 9/15 414/798.2
2011/0233850 A1 * 9/2011 Kruger ..... B65H 1/04 271/145
2012/0007306 A1 * 1/2012 Oota ..... B65H 31/06 271/207
2012/0067011 A1 * 3/2012 Holland-Letz ..... B65B 5/108 53/542
2012/0167529 A1 * 7/2012 Langhuber ..... B65B 11/08 53/467
2012/0195732 A1 * 8/2012 Moulin ..... B07C 3/008 414/788.1
2012/0261876 A1 * 10/2012 Berendes ..... B65H 31/06 271/18
2014/0001703 A1 * 1/2014 Petermann ..... B65H 29/46 271/220
2014/0196416 A1 * 7/2014 Duchstein ..... B65H 29/46 53/540
2014/0250837 A1 * 9/2014 Duchstein ..... B65B 25/14 53/447
2014/0327206 A1 * 11/2014 Kong ..... B65H 29/40 271/178
2014/0331612 A1 * 11/2014 Jeschke ..... B65H 31/309 53/447
2016/0281392 A1 * 9/2016 Duchstein ..... E05B 65/5246

* cited by examiner

DEVICE AND METHOD FOR FILLING A TRANSPORT CONTAINER WITH NOTES OF PECUNIARY VALUE

BACKGROUND

1. Field of the Invention

The invention relates to a device and to a method for filling a transport container with notes of pecuniary value.

2. Description of the Related Art

A device of this type includes a supply unit for supplying the notes of pecuniary value, a stacking unit for stacking the supplied notes of pecuniary value, a receiving unit for receiving a transport container and a displacement unit for conveying the stacked notes of pecuniary value into the transport container. The displacement unit includes a conveying element which, when conveying the notes of pecuniary value into the transport container, abuts flatly against the stack of notes of pecuniary value to be conveyed and is arranged substantially transversely with respect to an elongated pushing element, wherein the pushing element is connected to the conveying element at a first end. In addition, the device includes a closure unit for closing the filled transport container. Notes of pecuniary value are leaf-shaped documents of value, in particular bank notes, cheques, coupons, vouchers or the like.

A device of this type is used, for example, in automatic teller machines, in particular cash deposit machines, and automatic safes in which the notes of pecuniary value, in particular monetary notes, are deposited. The notes of pecuniary value input are stacked unsorted or sorted according to at least one criterion and are then deposited in transport containers. Once these have been filled with the notes of pecuniary value, the transport containers are preferably closed in a revision-proof manner. The closed transport containers are usually removed from the automatic teller machines or respectively the safes by a security transport company.

DE 10 2009 015 047 A1 by the same Applicant makes known a device for supplying notes of pecuniary value in a flexible transport container. The supplied notes of pecuniary value are stacked in a stacking unit, conveyed into a transport container by way of a displacement unit and said transport container is then closed.

In addition, documents WO 2009/138497 A1, WO 02/19289 A2, DE 10 2009 053 155 A1 and DE 10 2011 000 790 A1 describe in each case a device to which notes of pecuniary value can be supplied. Said notes are stacked and supplied to a transport container.

It is an object of the invention to provide a device for filling a transport container with notes of pecuniary value, which device is simple and compact in design as well as simple to handle and by means of which notes of pecuniary value can be stacked in a regular and reliable manner into the respective transport container. In addition, it is an object of the invention to provide a corresponding method of operation.

Said object is achieved by a device with the features of Claim 1. Advantageous further developments of the invention are provided in the dependent claims.

SUMMARY OF THE INVENTION

According to the invention, the notes of pecuniary value are inserted by the conveying unit into the transport container in stacks of notes of pecuniary value in such a manner that the notes of pecuniary value, when being supplied into the input region of said transport container which is formed by a movable frame which is described further below, are situated in the container cross section. The displacement unit includes a conveying element which, when conveying the notes of pecuniary value, abuts flatly against that note of pecuniary value of the stack of notes of pecuniary value which is supplied to the transport container as the last one in the respective filling step. In this case, the displacement unit conveys the stack of notes of pecuniary value at least so far into the transport container that between a container opening of the transport container and the note of pecuniary value abutting against the conveying element there is a predetermined minimum spacing. The term conveying the stack of notes of pecuniary value is to be understood both as conveying into the transport container a stack of notes of pecuniary value which was created outside the transport container by means of a stacking unit and conveying a stack of notes of pecuniary value which is already situated inside the transport container. The stack of notes of pecuniary value is consequently conveyed right into the transport container or further transport is effected in said transport container. The conveying of the stack of notes of pecuniary value is consequently effected in the stacking direction, i.e. in that direction in which the dimension of the stack of notes of pecuniary value increases when further notes of pecuniary value are supplied by the stacking unit.

The displacement unit includes an elongated pushing element which is connected to the conveying element at its first end and is driven by means of mechanical means at its second end which is located opposite the first end. In a first operating state in which notes of pecuniary value are conveyed into the transport container, the conveying element abuts flatly against the stack of notes of pecuniary value to be conveyed by way of a contact face. In this case, the dimensions of the contact faces match substantially the dimensions of the largest note of pecuniary value which can be supplied to the device.

Once the notes of pecuniary value have been conveyed into the transport container, the displacement unit is moved back out of the transport container. To prevent the notes of pecuniary value which are located close to the container opening from tipping up or leaving the transport container, the device includes a holding unit. Said holding unit holds the notes of pecuniary value transported into the transport container in the alignment and the position which they have once they have been supplied into the transport container. In particular, the holding element prevents the notes of pecuniary value from tipping up or moving in opposition to the supplying direction even once the displacement unit has been moved back out of the transport container.

The movable frame is arranged in the input region of the transport container. The frame includes two positionally fixed first frame elements which are arranged opposite one another and two second frame elements. The second frame elements are arranged so as to be movable toward one another and are guided by the first frame elements. When the second frame elements move, a frame opening is fully open or closed in part or completely.

As already described above, the conveying element in the first operating state abuts flatly against the stack of notes of pecuniary value to be conveyed and, as a result, prevents the notes of pecuniary value of the stack of notes of pecuniary value from tipping up. In the second operating state in which the displacement unit is moved back out of the transport container after the last filling step prior to the closing of the transport container, the conveying element assumes a second position in which it is arranged substantially in the direction of the longitudinal axis of the pushing element. In the second operating state, the face of the displacement unit which is aligned with respect to the container cross section is clearly smaller than the face of the notes of pecuniary value such that the displacement unit is able to be moved back through the partially closed frame opening. The falling out or tipping up of at least part of the notes of pecuniary value from the transport container is effectively prevented as a result of the partially closed frame opening, even when the stack of notes of pecuniary value supplied last is deposited at a minimum spacing which is other than that predetermined in the previous filling steps.

The conveying element preferably includes at least two individual elements. In the first operating state the two individual elements abut against the stack of notes of pecuniary value, each individual element having a part conveying face and all part conveying faces together forming the conveying face. The individual elements are movable in relation to one another and modify their relative position with respect to one another when changing between the first and the second operating state of the displacement unit. This enables a particularly simple design of the displacement unit.

In a preferred development of the individual elements, said individual elements are realized such that in the second operating state of the displacement unit the part conveying faces of adjacently arranged individual elements are arranged lying opposite one another.

In an advantageous embodiment of the displacement unit, the pushing element includes at least two longitudinal elements. The longitudinal elements are connected together so as to be movable at the second end of the pushing element, are arranged in a spread manner in a first position in the first operating state of the displacement unit and enclose a first angle on the second end of the pushing element. In the second operating state of the displacement unit, the longitudinal elements are arranged in a second position and at the second end enclose a second angle which is smaller than the first angle. The pushing element, in this case, is designed such that mechanical means on at least one of the longitudinal elements apply the force as a result of which the longitudinal elements are moved from the first into the second position.

It has proved to be particularly advantageous when the conveying element includes at least three individual elements, and at least one conveying element is arranged on the first end of the pushing element in the space between the longitudinal elements. Said embodiment achieves an optimum for the contradictory requirements for few movable mechanical parts in the displacement unit and, in the second operating state, for as large as possible a reduction in the face of the displacement unit which is aligned parallel to the container cross section.

The closure unit preferably includes the mechanical means which moves the displacement unit from the first into the second operating state. As a result, the device can be designed in a particularly simple manner.

A stack of notes of pecuniary value, which in each case includes at least one note of pecuniary value, is preferably supplied in each case to the transport container in several consecutive filling steps. In this connection, the top-most note of pecuniary value of the stack of notes of pecuniary value supplied in the respective filling step is deposited by the displacement unit at a position which is identical for each filling step, as a result of which the stack of notes of pecuniary value in the transport container moves the bottom of the transport container deeper and deeper into a receiving unit for receiving the transport container. The closure unit does not close the transport container until all of the stacks of notes of pecuniary value to be supplied to the transport container have been supplied.

The transport container preferably consists of flaccid material, for example foil material. A transport container of said material adapts particularly well, in the manner of a plastic bag, to the stack of notes of pecuniary values situated therein and is closable in a revision-proof manner by means of simple measures, for example welding or bonding.

It is advantageous when, in the final filling step, that is the last conveying of a stack of notes of pecuniary value into the transport container prior to the closing of the transport container, the stack of notes of pecuniary value supplied in said filling step are advanced in such a manner up to a location that the closure unit is able to close the transport container in an easy and reliable manner.

According to a further aspect of the invention, a method for filling a transport container is provided. The technical advantages are produced from the method of operation of the device which is described further above and below.

The invention is explained below by way of an exemplary embodiment with reference to the figures.

DETAILED DESCRIPTION OF THE PREFERRED EMBODIMENTS

Figure 1:
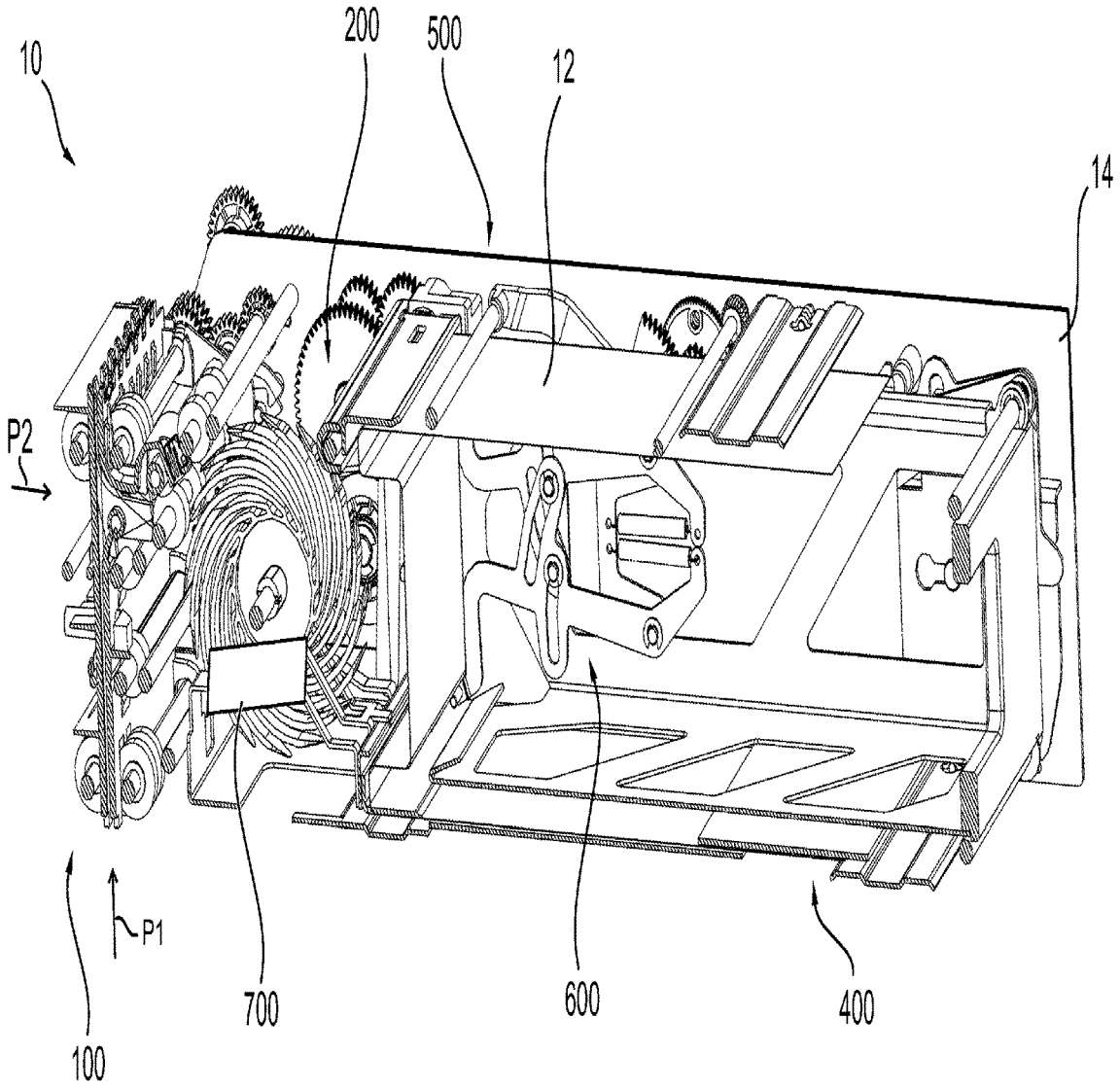
FIG. 1 shows a schematic sectioned representation of a device for filling a transport container with notes of pecuniary value.

The present invention follows a device as is known from DE 10 2009 015 0147 A1 by the same Applicant. FIG. 1 describes a schematic sectioned representation of a device 10 for filing a transport container 12 with notes of pecuniary value. The transport container 12 shown is a thin-walled transport container of flexible material, preferably of plastics material foil and/or woven material. The transport container 12 is pulled over a mobile frame 16 (said frame 16 is shown schematically in FIGS. 5 to 7) with its inside surface turned outward. When filling the transport container 12 with notes of pecuniary value, the notes of pecuniary value are conveyed toward the bottom of the transport container 12 or toward the notes of pecuniary value already deposited in the transport container 12, as a result of which the bottom of the transport container 12 is pressed deeper into the frame 16 and when the transport container 12 is dragged its inside surface which is turned outward is turned back inward. A container opening of the transport container 12, through which the notes of pecuniary value are supplied to the transport container 12, is in particular rectangular and at least as large as the largest note of pecuniary value to be received into the transport container 12. In this case, the container opening is defined by the region into which the inside surface of the transport container 12 which is turned outward is turned inward again around the frame 16.

The device 10 includes a supply unit 100 for supplying the notes of pecuniary value, a stacking unit 200 for stacking the notes of pecuniary value, a receiving unit 400 for receiving the transport container 12, a holding unit 500 for holding the notes of pecuniary value in the transport container 12, a closure unit 600 for closing the transport container 12, a displacement unit 700 (only shown schematically as a block in FIG. 1; the displacement unit 700 is shown in detail in the further Figures) and a framework 14. The framework 14 essentially serves for stabilizing the device 10 in a mechanical manner.

By means of the supply unit 100 the notes of pecuniary value to be deposited into the transport container 12 are supplied to the stacking unit 200, which stacks the notes of pecuniary value in the form of an orderly stack of notes of pecuniary value. The notes of pecuniary value are suppliable to the supply unit 100 in the direction of the arrow P1 and/or in opposition to said direction. The supply unit 100 includes a point (not shown), by means of which the notes of pecuniary value to be supplied to the transport container 12 are diverted from a transport path and supplied in the direction of the arrow P2 to the stacking unit 200. The design and operation of the supply unit 100, the stacking unit 200 and the receiving unit 400 are known to the expert from the prior art, for example from document DE 10 2009 015 047 A1 of the same Applicant, which is hereby incorporated into the present description by reference.

The displacement unit 700 conveys the stack of notes of pecuniary value created by the stacking unit 200 into the transport container 12. The design and operation of the displacement unit 700 is described further below in conjunction with FIGS. 2 to 5.

Once the stack of notes of pecuniary value has been conveyed into the transport container 12, the displacement unit 700 is moved back out of the transport container 12. The stack of notes of pecuniary value conveyed into the transport container 12 is held by the holding unit 500 approximately in the position in which it was conveyed into the transport container 12. In particular, a tipping up of the individual notes of pecuniary value of the stack of notes of pecuniary value or the same falling out of the transport container 12 in opposition to the supplying direction is prevented. Consequently, the achievement is that the notes of pecuniary value deposited in the transport container 12 remain in the form of a stack of notes of pecuniary value in the transport container 12 even once the displacement unit 700 has been moved back out. If all the notes of pecuniary value to be conveyed into the transport container 12 are in the transport container 12, said transport container is closed by the closure unit 600. The design and operation of the holding unit 500 and of the closure unit 600 are known to the expert, for example from document DE 10 2009 015 047 A1 of the Applicant which has already been mentioned above. In particular, the closure unit 600 includes the movable frame 16.

Figure 2:
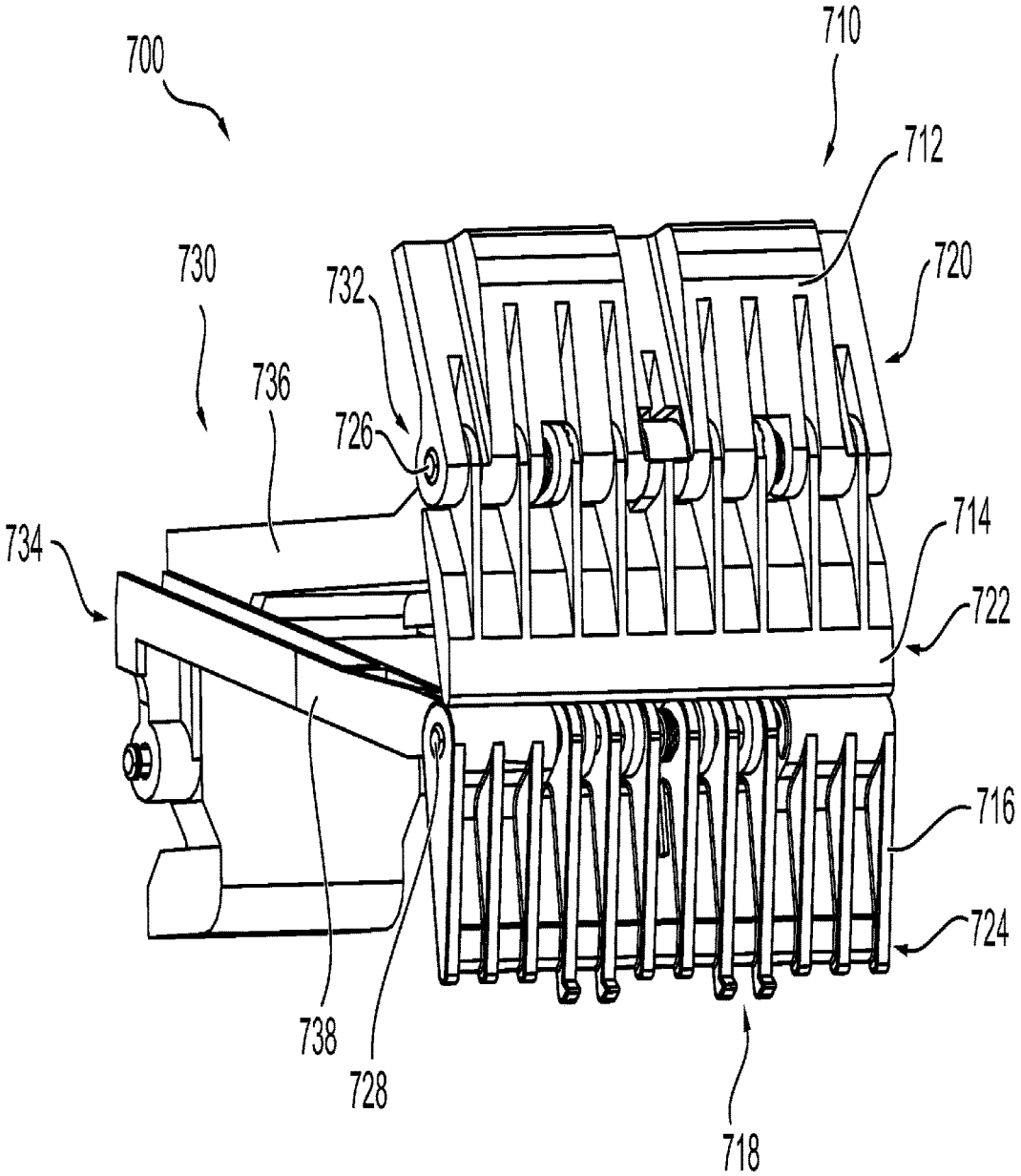
FIG. 2 shows a perspective representation of a displacement unit according to FIG. 1.

FIG. 2 shows a perspective representation of a displacement unit 700 according to FIG. 1. The displacement unit 700 includes a conveying element 710 for conveying the stacked notes of pecuniary value into the transport container 12 and a pushing element 730 which is connected to the conveying element 710 at its first end 732 and at its second end 734 is operatively connected to mechanical means (not shown). In the first operating state of the displacement unit 700, the pushing element 730 pushes the conveying element 710 into the transport container 12 and in the second operating state of the displacement unit 700, the pushing element 730 moves the conveying element 710 back out of the transport container 12.

In the shown first operating state of the displacement unit 700, the conveying element 710 is arranged substantially transversely with respect to the pushing element 730 and includes a first individual element 712, a second individual element 714 and a third individual element 716. The individual elements 712 to 716 are movable in relation to one another. To this end, the first individual element 712 and the second individual element 714 are arranged on a first shaft 726, whilst a second shaft 728 is provided for the third individual element 716.

The conveying element 710 forms a conveying face 718 on its side facing the stack of notes of pecuniary value to be conveyed. In the first operating state the conveying face 718 abuts against the stack of notes of pecuniary value to be conveyed and conveys said stack preferably by displacing it into the transport container 12. In this connection, the conveying face 718 is the part of the displacement unit 700 which is in contact with the stack of notes of pecuniary value to be conveyed. The conveying face 718 includes a first part conveying face 720 on the first individual element 712, a second part conveying face 722 on the second individual element 714 and a third part conveying face 724 on the third individual element 716.

The pushing element 730 includes a first longitudinal element 736 and a second longitudinal element 738, which are connected together so as to be movable on the second end 734 of the pushing element 730. In the first operating state of the displacement unit 700 shown in FIG. 2, the longitudinal elements 736, 738 are spread apart and enclose a first angle on the second end 734 of the pushing element 730. On the first end 732 of the pushing element 730, the first longitudinal element 736 is connected to the first shaft 726 in such a manner that, in each case, the first individual element 712 and the second individual element 714 is arranged so as to be movable with respect to the first longitudinal element 736. The second longitudinal element 738 is connected to the second shaft 728 on the first end 732 of the pushing element 730 in such a manner that the third individual element 716 is movable relative to the second longitudinal element 738.

Figure 3:
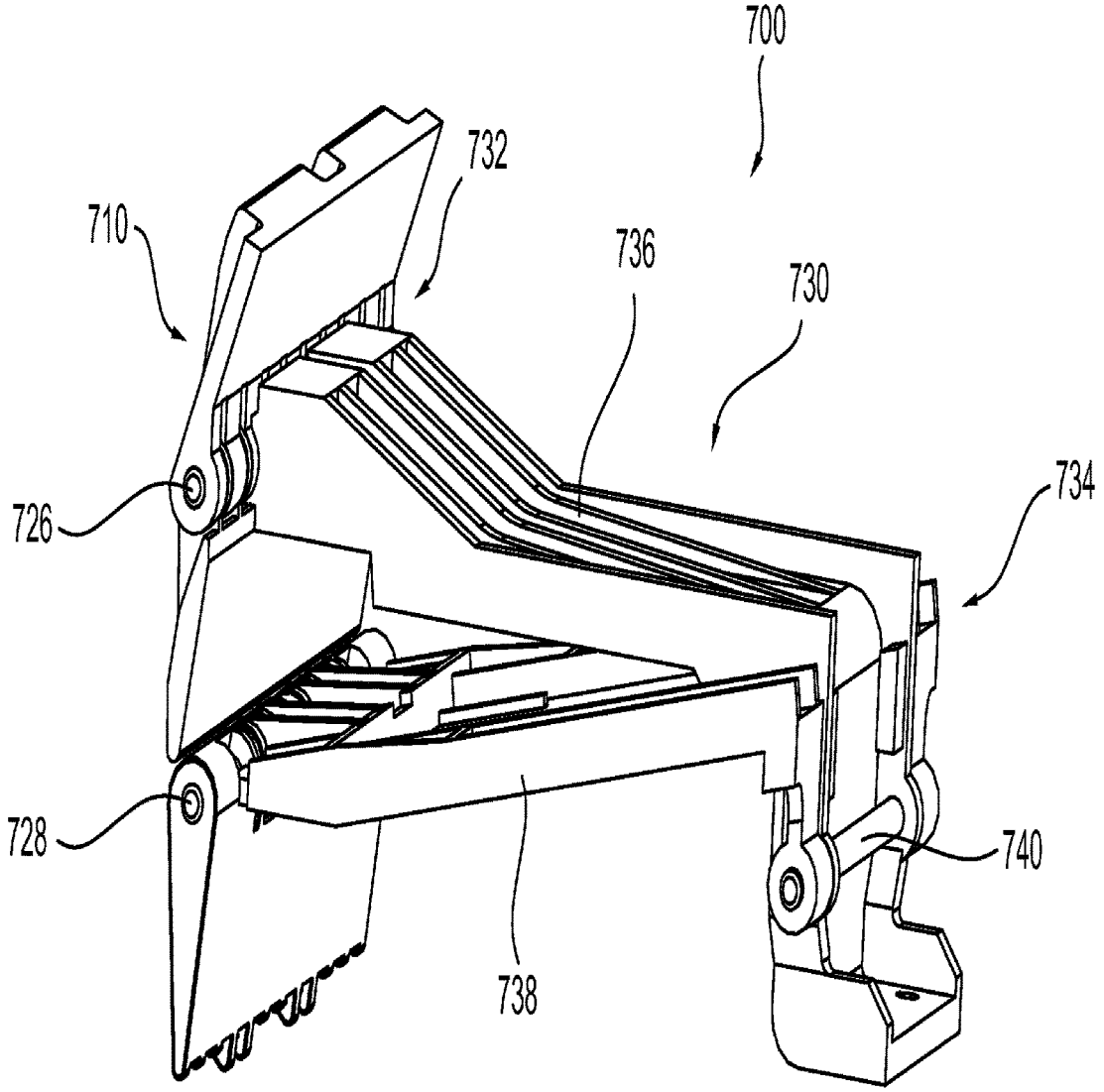
FIG. 3 shows a further perspective representation of a displacement unit according to FIG. 2.

FIG. 3 shows a further perspective representation of the displacement unit 700 according to FIG. 2. A third shaft 740 connects the first longitudinal element 736 and the second longitudinal element 738 together so as to be movable on the second end 734 of the pushing element 730. Mechanical means (not shown) are provided on the first end 732 of the pushing element 730 in such a manner that a relative movement of the longitudinal elements 736, 738 toward one another brings about a relative movement of the individual elements 712 to 716 toward one another. The relative movement of the longitudinal elements 736, 738 toward one another transfers the displacement unit 700 from the first operating state into a second operating state. It is advantageous when the relative movement of the longitudinal elements 736, 738 toward one another is triggered as a result of the closure unit 600 pressing onto the longitudinal elements 736, 738 and, as a result, moving the longitudinal elements 736, 738 out of the spread position into a further, less spread position.

Figure 4:
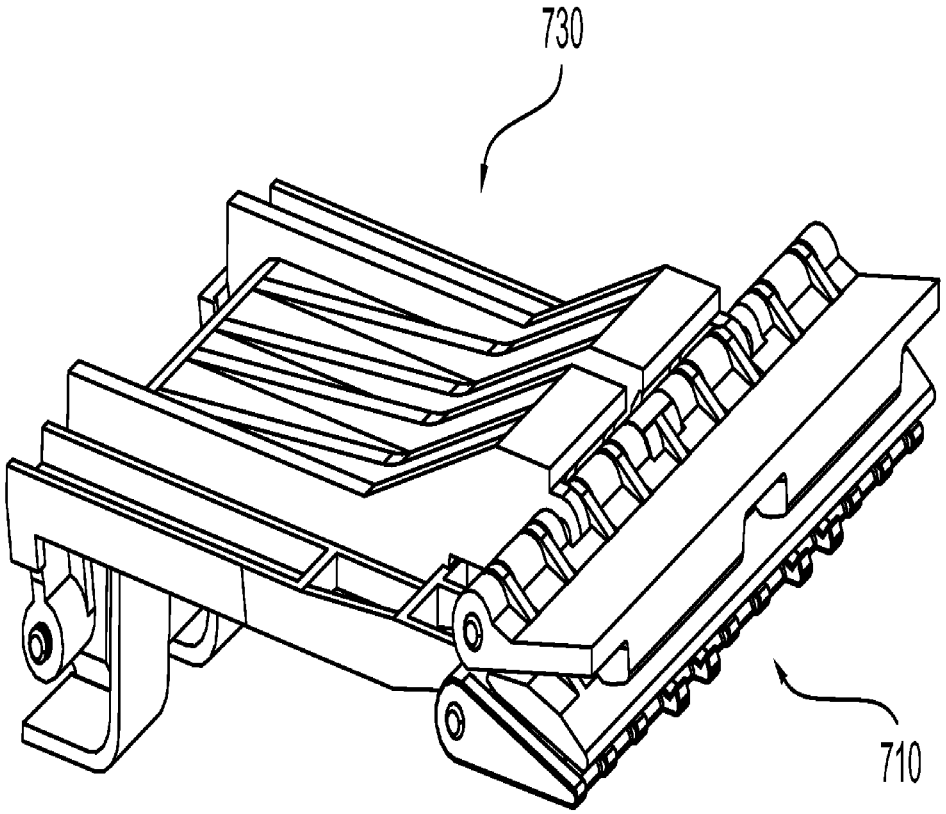
FIG. 4 shows a displacement unit according to FIGS. 2 and 3 in the second operating state.

FIG. 4 shows the displacement unit 700 according to FIGS. 2 and 3 in the second operating state. The longitudinal elements 736, 738 are in a further position in which the angle enclosed by the longitudinal elements 736, 738 on the second end 734 of the pushing element 730 is smaller than the angle which the longitudnal elements 736, 738 enclose in the first operating state. In the second operating state shown in FIG. 4, the displacement unit 700 is moved back out of the transport container 12 through the partially closed frame 16. In this case, the individual elements 712 to 716 are arranged in such a manner that the part conveying faces 720 to 724 extend approximately in the direction of the longitudinal axes of the longitudinal elements 736, 738. The first part conveying face 720 and the second part conveying face 722 are arranged situated opposite one another. The third part conveying face 724 of the third individual element 716 is aligned toward the second individual element 714. In the second operating state of the displacement unit 700, its cross section is clearly reduced in the direction of the container cross section of the transport container 12 compared to the first operating state. Thus, when the transport container 12 is closed, the closure unit 600 can close the frame 16 in part and, as a result, reduce the container opening of the transport container 12 so far that even once the displacement unit 700 has been moved back out of the transport container 12, no notes of pecuniary value are able to tilt over in the transport container 12 or fall out of the transport container 12.

Figure 5:
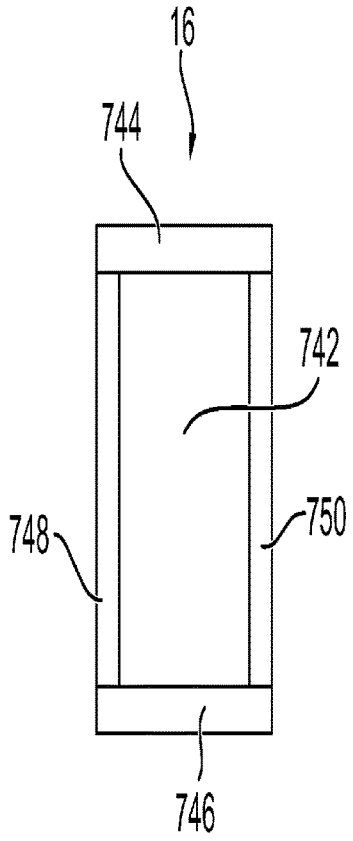
FIG. 5 shows a schematic representation of a movable frame in the open state.
Figure 6:
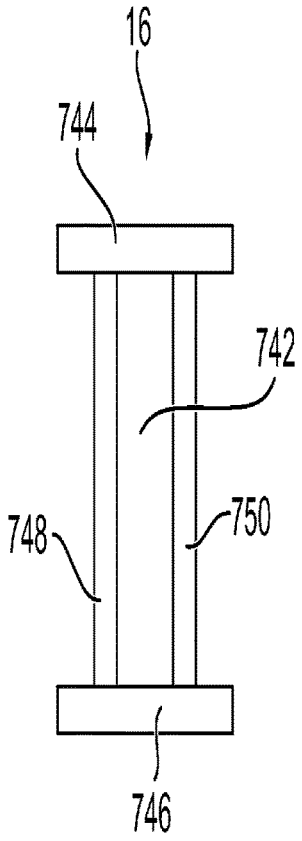
FIG. 6 shows a schematic representation of the frame according to FIG. 5 in the partially closed state.
Figure 7:
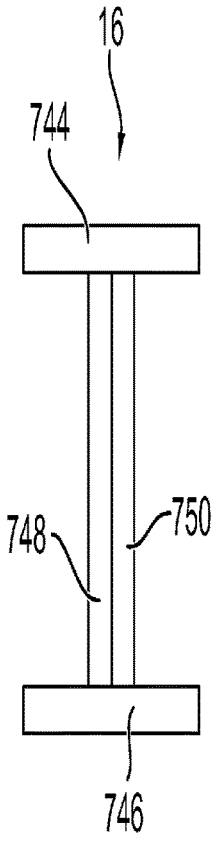
FIG. 7 shows a schematic representation of the frame according to FIGS. 5 and 6 in the closed state.

FIGS. 5, 6 and 7 show in each case a schematic representation of the movable frame 16, FIG. 5 showing the open state, FIG. 6 the partially closed state and FIG. 7 the closed state. The frame 16 includes two first positionally fixed frame elements 744, 746 which are situated opposite one another. In addition, the frame 16 includes two second frame elements 748, 750 which are movable in relation to one another and are guided by the first frame elements 744, 746. A movement of the second frame elements 748, 750 modifies the size of a frame opening 742 which is spanned by the frame 16.

In the state shown in FIG. 5, the frame 16 is fully open and the frame opening 742 reaches its maximum size which is greater than the size of the largest note of pecuniary value which is suppliable to the transport container 12. In said state the notes of pecuniary value to be supplied to the transport container 12 pass through the frame 16. When the transport container 12 is closed, the frame 16 is first of all closed in part as shown in FIG. 6, before the displacement unit 700 is moved back out of the transport container. The closing of the frame 16 moves the displacement unit 700 into its second operating state by the second frame elements 748, 750 pressing onto the longitudinal elements 736, 738. As a result, the individual elements 712 to 716 are directed in such a manner, as described in conjunction with FIG. 4, such that the displacement unit 700 passes through the reduced frame opening 742. The movable frame 16 is then completely closed as shown in FIG. 7 and after this the transport container 12 can be closed in a revision-proof manner by the closure unit 600.

What is claimed is:

1. A method for filling a transport container of flexible material with notes of pecuniary value comprising:

opening a frame opening of a moveable frame of a closure unit;

abutting a stack of the notes with a displacement unit in a first operating state;

conveying the stack of the notes through the frame opening and into the transport container with the displacement unit while the frame opening is fully open;

partially closing the frame opening after said conveying while the displacement unit extends through the frame opening whereby the frame opening acts on the displacement unit to assume a second operating state in which a cross sectional area of a face of the displacement unit, which includes a portion that contacts the stack of notes, is sufficiently structurally reduced for the displacement unit to pass through the partially closed frame opening; and withdrawing the displacement unit out of the frame opening while the displacement unit is in the second operating state.

2. The method of claim 1 further comprising:

forming the displacement unit to include a conveying element, the conveying element including at least two individual elements, wherein each of the individual elements has a part conveying face and all the part conveying faces together form the conveying face, and in that to reach the second operating state at least two part conveying faces of adjacently arranged individual elements are pivoted toward one another during said partially closing.

3. The method of claim 1 wherein said opening is further defined as:

opening the frame opening of the moveable frame of the closure unit such that the frame opening is opened to its maximum size.

4. The method of claim 1 wherein said abutting is further defined as abutting the stack of the notes with a plurality of individual elements of the displacement unit which are positioned side-by-side to form a conveying face while the displacement unit is in the first operating state.

5. The method of claim 4 further comprising:

interconnecting at least two of the plurality of individual elements in moveable relation with one another with a first shaft.

6. The method of claim 5 further comprising:

connecting the plurality of individual elements to longitudinal elements of the displacement unit for moveable relation with a plurality of shafts including the first shaft.

7. The method of claim 6 wherein said partially closing further comprises pressing the longitudinal elements of the displacement unit together with frame elements of the moveable frame that define opposite sides of the frame opening.

* * * * *